US009583836B2

(12) United States Patent
Kato et al.

(10) Patent No.: US 9,583,836 B2
(45) Date of Patent: Feb. 28, 2017

(54) HIGH-FREQUENCY TRANSMISSION LINE AND ANTENNA DEVICE

(71) Applicant: Murata Manufacturing Co., Ltd., Nagaokakyo-shi, Kyoto-fu (JP)

(72) Inventors: Noboru Kato, Nagaokakyo (JP); Satoshi Sasaki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 257 days.

(21) Appl. No.: 14/077,345

(22) Filed: Nov. 12, 2013

(65) Prior Publication Data

US 2015/0130683 A1 May 14, 2015

(51) Int. Cl.

| | |
|---|---|
| ***H01P 3/02*** | (2006.01) |
| ***H01Q 9/04*** | (2006.01) |
| ***H01P 3/08*** | (2006.01) |
| *H01P 5/02* | (2006.01) |

(52) U.S. Cl.
CPC ..... *H01Q 9/045* (2013.01); *H01P 3/085* (2013.01); *H01P 5/028* (2013.01)

(58) Field of Classification Search
CPC .... H01P 5/02; H01P 5/04; H01P 3/085; H01P 5/028; H01Q 9/045
USPC ..... 333/33
See application file for complete search history.

(56) References Cited

U.S. PATENT DOCUMENTS

| | | | | |
|---|---|---|---|---|
| 6,424,309 | B1 * | 7/2002 | Johnston | H01Q 9/28 343/725 |
| 6,590,468 | B2 * | 7/2003 | du Toit | H01P 5/028 333/17.3 |
| 2003/0160727 | A1 | 8/2003 | Ebine et al. | |
| 2004/0000963 | A1 * | 1/2004 | Killen | H01P 5/02 333/35 |

(Continued)

FOREIGN PATENT DOCUMENTS

| | | | |
|---|---|---|---|
| JP | 9-321507 | A | 12/1997 |
| JP | 2003-060425 | A | 2/2003 |

(Continued)

OTHER PUBLICATIONS

Official Communication issued in corresponding Japanese Patent Application No. 2014-254737, mailed on Nov. 4, 2015.

(Continued)

*Primary Examiner* — Stephen E Jones
*Assistant Examiner* — Scott S Outten
(74) *Attorney, Agent, or Firm* — Keating & Bennett, LLP

(57) ABSTRACT

An antenna is connected to a first end of a high-frequency transmission line, and a connector is connected to a second end of the high-frequency transmission line. A characteristic impedance of a microstrip line is higher than characteristic impedances of first and second strip lines, and a characteristic impedance of a coplanar line is higher than a characteristic impedance of the second strip line. Thus, at a certain frequency, a standing wave develops in which the position of the microstrip line and the position of the coplanar line are maximum voltage points and three-quarter-wavelength reso- (Continued)

nance is a fundamental wave mode. Thus, the cutoff frequency of the high-frequency transmission line is high, and an insertion loss of a signal is significantly reduced to be low over a wide band.

20 Claims, 19 Drawing Sheets

(56) References Cited

U.S. PATENT DOCUMENTS

2013/0093633 A1* 4/2013 Henderson ..... H01Q 1/273
343/718

FOREIGN PATENT DOCUMENTS

| | | | |
|---|---|---|---|
| JP | 2004-064282 | A | 2/2004 |
| WO | 2011/007660 | A1 | 1/2011 |
| WO | 2011/021677 | A1 | 2/2011 |

OTHER PUBLICATIONS

Konishi, Y., "Basics and Applications of Microwave Circuits—Basic Knowledge to New Appications," Sogo Denshi Publishers, Aug. 20, 1990. 10 pages.

* cited by examiner

HIGH-FREQUENCY TRANSMISSION LINE AND ANTENNA DEVICE

BACKGROUND OF THE INVENTION

1. Field of the Invention

The present invention relates to high-frequency signal lines, and particularly relates to a high-frequency transmission line connected between an antenna end and a connector end.

2. Description of the Related Art

In electronic apparatuses that handle high-frequency signals, such as mobile communication terminals, a high-frequency transmission line for transmitting high-frequency signals is used in a signal processor. For example, in mobile communication terminals, a coaxial cable of 50Ω or 75Ω is used.

A connector may be provided between such a coaxial cable and a high-frequency signal processor, as disclosed in, for example, Japanese Unexamined Patent Application Publications No. 2003-060425 and No. 2004-064282. FIGS. 1A to 1C illustrate an example thereof. FIG. 1A is a cross-sectional view of a coaxial cable 100, and FIG. 1B illustrates a state where a connector 40 is attached to one end of the coaxial cable 100.

For example, in a case where an antenna is connected to a first end of a high-frequency transmission line such as a coaxial cable, and a connector is connected to a second end of the high-frequency transmission line, a high-frequency signal received by the antenna is transmitted to a high-frequency signal processor via the coaxial cable and the connector.

In ordinary cases, however, the characteristic impedance of the antenna is lower than the characteristic impedance of the coaxial cable (normally 50Ω or 75Ω), whereas the characteristic impedance of the connector is higher than the characteristic impedance of the coaxial cable. Accordingly, resonance occurs at a frequency at which a standing wave of a quarter wavelength multiplied by an odd number develops in the coaxial cable.

FIG. 1C is a diagram illustrating that state. In FIG. 1C, in a case where an antenna is connected to a first end FP, and a connector is connected to a second end SP, because the impedance is low at the first end FP and the impedance is high at the second end SP, resonance occurs at a frequency at which a standing wave develops in which the first end FP is a minimum voltage point (short-circuit end) and the second end SP is a maximum voltage point (open end).

Here, one wavelength in the coaxial cable 100 is represented by λg, the length of the coaxial cable 100 is represented by Lg, and the relative dielectric constant of the dielectric material of the coaxial cable 100 is represented by ∈r. In this case, a resonance frequency fo of a fundamental wave at which quarter-wavelength resonance occurs is expressed by the following equation (1).

$$fo=1/(4Lg\sqrt{\in r})\times c \quad (c\text{: velocity of light}) \tag{1}$$

In a case where Lg=9 cm and √∈r=1, resonance in a basic mode occurs at about 830 MHz. Thus, the cutoff frequency of the coaxial cable 100 is lower than about 830 MHz. In this case, for example, in the case of transmitting a signal in a 900 MHz band, an insertion loss in the coaxial cable 100 is a problem.

SUMMARY OF THE INVENTION

Preferred embodiments of the present invention provide a high-frequency transmission line having a cutoff frequency higher than that of a structure according to the related art to reduce an insertion loss over a wide band, and an antenna device including such a high-frequency transmission line.

A high-frequency transmission line according to a preferred embodiment of the present invention includes a first end serving as a low-impedance end and a second end serving as a high-impedance end. A portion of the high-frequency transmission line includes a low-impedance portion having a low characteristic impedance, and a high-impedance portion having a characteristic impedance higher than the low-impedance portion. The low-impedance portion and the high-impedance portion are arranged so that resonance of a quarter wavelength multiplied by an odd number that is three or higher occurs.

A high-frequency transmission line according to another preferred embodiment of the present invention includes a first end serving as a low-impedance end and a second end serving as a high-impedance end. A portion of the high-frequency transmission line includes a low-impedance portion having a low characteristic impedance, and a high-impedance portion having a characteristic impedance higher than the low-impedance portion. The low-impedance portion and the high-impedance portion are arranged so that resonance occurs in which a number of antinodes in a voltage strength distribution is two or more.

Preferably, the low-impedance portion includes a strip line, and the high-impedance portion includes a microstrip line or a coplanar line.

Preferably, for example, the low-impedance end is an antenna connection end, and the high-impedance end is a connector connection end.

Preferably, the high-frequency transmission line is constituted by a multilayer body including a plurality of dielectric layers and line conductors (signal lines and ground lines), and is bent at the high-impedance portion.

Preferably, the high-impedance portion has a smaller number of dielectric layers than the low-impedance portion.

An antenna device according to a further preferred embodiment of the present invention includes the high-frequency transmission line according to any of the preferred embodiments of the present invention described above, and an antenna element connected to the low-impedance end. The high-frequency transmission line is constituted by a multilayer body including a plurality of dielectric layers and line conductors, and the antenna element is provided in the multilayer body integrally with the high-frequency transmission line.

According to various preferred embodiments of the present invention, resonance of a quarter wavelength multiplied by an odd number that is three or higher occurs, and quarter-wavelength resonance does not occur. Thus, a fundamental wave mode (lowest-order harmonic mode) of a high-frequency transmission line is a three-quarter-wavelength resonance mode. Accordingly, even if the width of the line is approximated to the wavelength of the frequency of a signal to be transmitted, the lowest-order cutoff frequency is three times the frequency of a high-frequency transmission line having a structure according to the related art, and a low insertion loss characteristic is obtained over a wide band.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 2C:
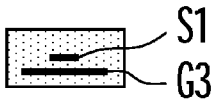
FIGS. 2A to 2E are cross-sectional views of individual portions of a high-frequency transmission line according to a first preferred embodiment of the present invention.
Figure 2E:
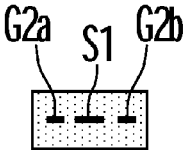
Figure 2A:
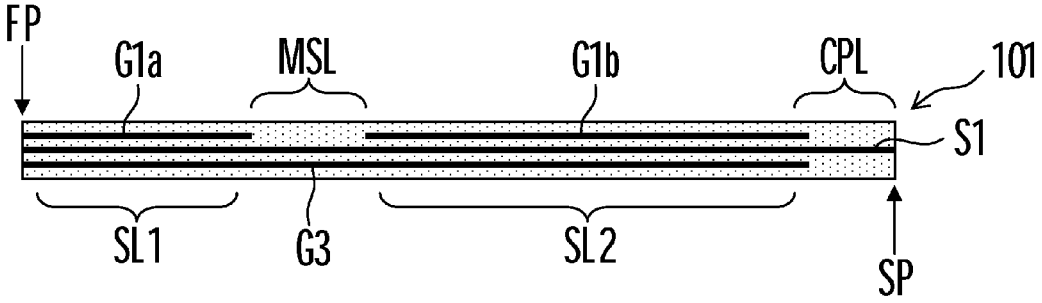
Figure 2B:
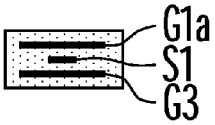
Figure 2D:
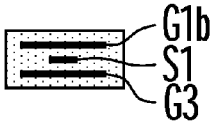
Figure 3:
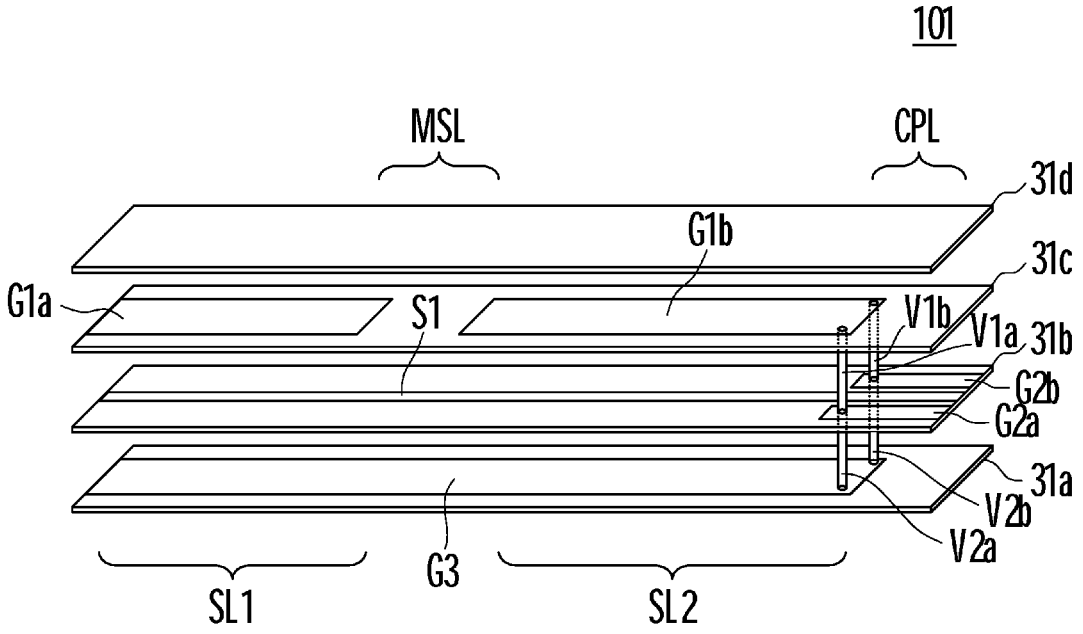
FIG. 3 is an exploded perspective view of the high-frequency transmission line according to the first preferred embodiment of the present invention.

FIGS. 2A to 2E are cross-sectional views of individual portions of a high-frequency transmission line 101 according to a first preferred embodiment of the present invention. FIG. 3 is an exploded perspective view of the high-frequency transmission line 101. FIG. 2A is a cross-sectional view in the longitudinal direction of the high-frequency transmission line 101. FIG. 2B is a cross-sectional view of the portion of a first strip line SL1 in FIG. 2A, FIG. 2C is a cross-sectional view of the portion of a microstrip line MSL in FIG. 2A, FIG. 2D is a cross-sectional view of the portion of a second strip line SL2 in FIG. 2A, and FIG. 2E is a cross-sectional view of the portion of a coplanar line (coplanar waveguide) CPL in FIG. 2A.

As illustrated in FIG. 2A, the high-frequency transmission line 101 includes the first strip line SL1, the microstrip line MSL, the second strip line SL2, and the coplanar line CPL.

As illustrated in FIG. 3, the high-frequency transmission line 101 includes four dielectric substrates (hereinafter simply referred to as substrates) 31*a*, 31*b*, 31*c*, and 31*d*. A ground line G3 is located on the upper surface of the substrate 31*a*. A signal line S1 and two ground lines G2*a* and G2*b* are located on the upper surface of the substrate 31*b*. Two ground lines G1*a* and G1*b* are located on the upper surface of the substrate 31*c*. Via conductors V1*a* and V1*b* to connect the ground line G1*b* and the ground lines G2*a* and G2*b* are located on the substrate 31*b*. V1*a* conductors V2*a* and V2*b* to connect the ground line G3 and the ground lines G2*a* and G2*b* are located on the substrate 31*a*. The high-frequency transmission line 101 is a multilayer body including the substrates 31*a*, 31*b*, 31*c*, and 31*d* on which these various conductive lines are located.

The first strip line SL1 includes the ground lines G1*a* and G3 and the signal line S1, and is constituted by these conductive lines and the dielectric layers of the substrates. Likewise, the second strip line SL2 includes the ground lines G1*b* and G3 and the signal line S1, and is constituted by these conductive lines and the dielectric layers of the substrates. The microstrip line MSL includes the ground line G3 and the signal line S1, and is constituted by these conductive lines and the dielectric layers of the substrates. The coplanar line CPL includes the ground lines G2*a* and G2*b* and the signal line S1, and is constituted by these conductive lines and the dielectric layers of the substrates.

Figure 4A:
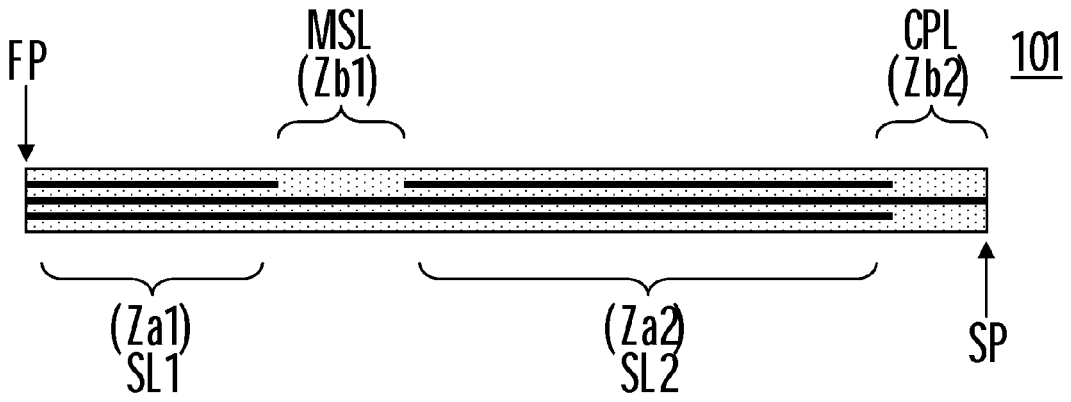
FIG. 4A is a diagram illustrating the characteristic impedances of individual portions of the high-frequency transmission line.
Figure 4B:
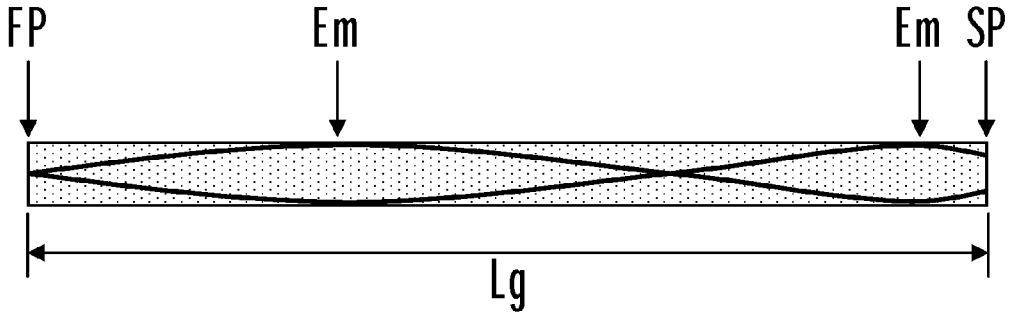
FIG. 4B is a diagram illustrating an example of a standing wave that develops in the high-frequency transmission line.

FIG. 4A is a diagram illustrating the characteristic impedances of individual portions of the high-frequency transmission line 101, and FIG. 4B is a diagram illustrating an example of a standing wave that develops in the high-frequency transmission line 101.

Each of the characteristic impedances Za1 and Za2 of the first and second strip lines SL1 and SL2 preferably is about 50Ω, for example. The characteristic impedance Zb1 of the microstrip line MSL preferably is about 75Ω, for example. The characteristic impedance Zb2 of the coplanar line CPL preferably is about 200Ω, for example.

In a case where an antenna is connected to a first end FP of the high-frequency transmission line 101 and a connector is connected to a second end SP of the high-frequency transmission line 101, because the first end FP is a low-impedance end and the second end SP is a high-impedance end, resonance occurs at a frequency at which a standing wave develops in which the first end FP is a minimum voltage point (short-circuit end) and the second end SP is a maximum voltage point (open end). However, the characteristic impedance Zb1 of the microstrip line MSL is higher than the characteristic impedances Za1 and Za2 of the first and second strip lines SL1 and SL2 (Zb1>(Za1, Za2)), and thus a standing wave develops in which the position of the microstrip line MSL is a maximum voltage point (an antinode in a voltage strength distribution), as illustrated in FIG. 4B. Also, the characteristic impedance Zb2 of the coplanar line CPL is higher than the characteristic impedance Za2 of the second strip line SL2 (Zb2>Za2), and thus, at a certain frequency, a standing wave develops in which the position of the coplanar line CPL is a maximum voltage point (an antinode in a voltage strength distribution), as illustrated in FIG. 4B.

Figure 1A:
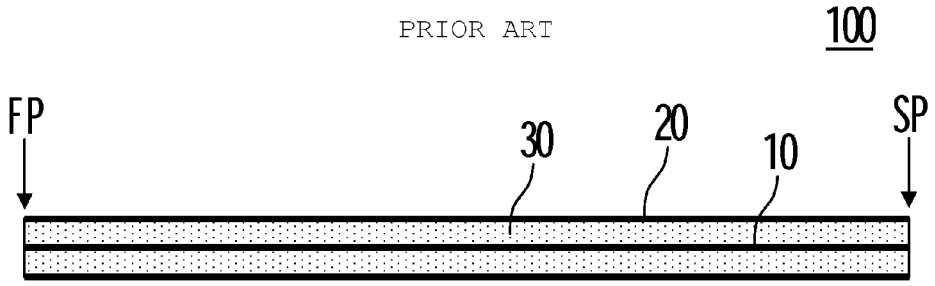
FIG.1A PRIOR ART
FIG. 1A is a cross-sectional view of a coaxial cable according to the related art.
Figure 1B:
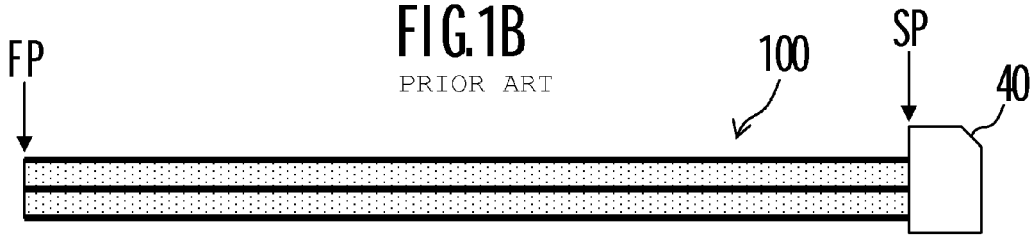
FIG.1B PRIOR ART
FIG. 1B is a diagram illustrating a state where a connector is attached to one end of the coaxial cable.
Figure 1C:
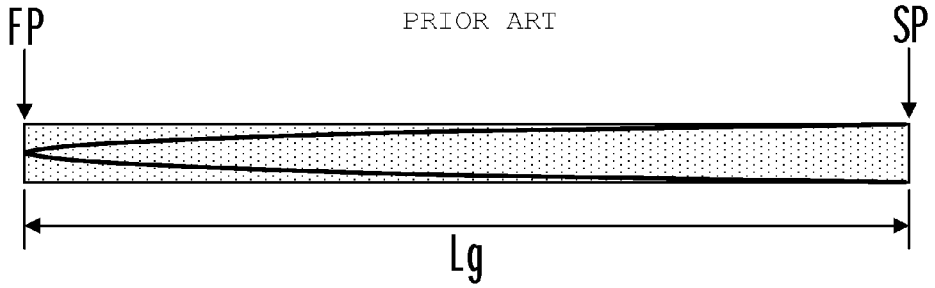
FIG.1C PRIOR ART
FIG. 1C is a diagram illustrating a state where a standing wave of a quarter wavelength develops in the coaxial cable.

Therefore, a quarter-wavelength resonance mode illustrated in FIG. 1C does not occur. This is because, in the quarter-wavelength resonance mode, the voltage is not maximum at the portion of the microstrip line MSL. Thus, three-quarter-wavelength resonance is a fundamental wave (lowest-order harmonic) mode, and resonance of a quarter wavelength multiplied by an odd number that is three or higher occurs. Accordingly, resonance occurs in which the number of maximum voltage points Em (antinodes in a voltage strength distribution) is two or more. In other words, the first and second strip lines SL1 and SL2, the microstrip line MSL, and the coplanar line CPL are disposed so that the positions of the maximum voltage points Em correspond to a high-impedance portion of the transmission line and so that a region separated therefrom corresponds to a low-impedance portion.

Figure 4C:
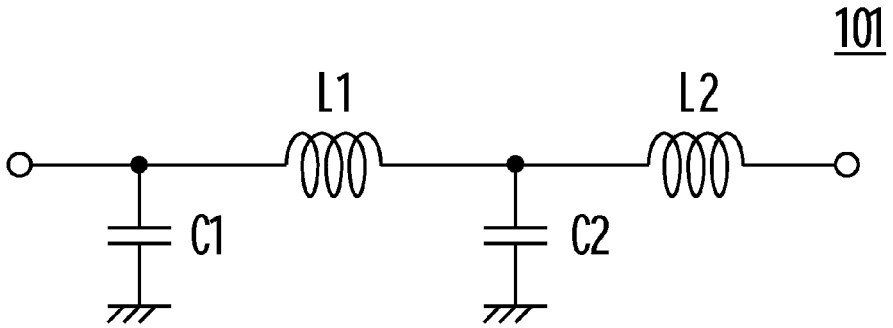
FIG. 4C is an equivalent circuit diagram in which the high-frequency transmission line is represented by a lumped-constant circuit.

FIG. 4C is an equivalent circuit diagram in which the high-frequency transmission line 101 is represented by a lumped-constant circuit. At the maximum voltage point Em and the vicinity thereof of the high-frequency transmission line 101, the density of electric field energy is high and the density of magnetic field energy is low. As the distance from the maximum voltage point Em increases, the density of electric field energy decreases and the density of magnetic field energy increases. Therefore, the portions where the density of electric field energy is high are represented by capacitors C1 and C2, and the portions where the density of magnetic field energy is high are represented by inductors L1 and L2.

Figure 5:
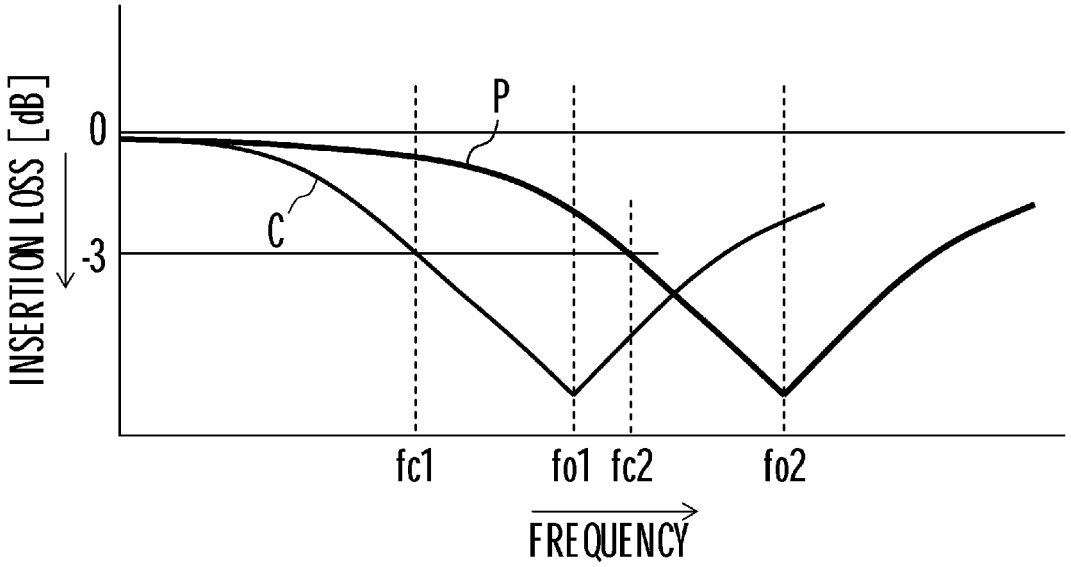
FIG. 5 is a diagram illustrating the frequency characteristics of an insertion loss of the high-frequency transmission line.

FIG. 5 is a diagram illustrating the frequency characteristics of an insertion loss of the high-frequency transmission line 101. In FIG. 5, a curve C represents the characteristics of a high-frequency transmission line whose characteristic impedance is constant over the entire length, as in the example illustrated in FIGS. 1A to 1C. A curve P represents the characteristics of the high-frequency transmission line 101 according to the first preferred embodiment. As illustrated in FIG. 4C, the high-frequency transmission line 101 functions as an equivalent low-pass filter. Thus, the frequency characteristics of the insertion loss of the high-frequency transmission line 101 are similar to the frequency characteristics of an LC low-pass filter, as illustrated in FIG. 5.

In FIG. 5, the resonance frequency for quarter-wavelength resonance of the high-frequency transmission line having a structure according to the related art is fo1, and a frequency fc1 attenuated by 3 dB is the cutoff frequency thereof. The resonance frequency for three-quarter-wavelength resonance of the high-frequency transmission line 101 is fo2, and a frequency fc2 attenuated by 3 dB is the cutoff frequency thereof. In this way, the cutoff frequency fc2 of the high-frequency transmission line 101 according to the first preferred embodiment is high, and a low insertion loss characteristic can be obtained over a wide band.

Here, one wavelength on the high-frequency transmission line 101 is represented by λg, and the line length is represented by Lg. In this case, the resonance frequency fo2 for three-quarter-wavelength resonance is expressed by the following equation (2).

$$fo2=3/(4Lg\sqrt{\in r})\times c(c\text{: velocity of light}) \quad (2)$$

In a case where Lg=9 cm and $\sqrt{\in r}=1$, three-quarter-wavelength resonance occurs at a high frequency of about 2.5 GHz. Thus, for example, a 900 MHz band is sufficiently lower than the cutoff frequency fc2, and the insertion loss of the signal is significantly reduced so as to be low.

A slight impedance mismatch occurs at the boundaries between the microstrip line MSL and the first and second strip lines SL1 and SL2, and the boundary between the second strip line SL2 and the coplanar line CPL. However, a return loss caused by the impedance mismatch is negligible compared to the above-described effect of reducing an insertion loss.

As illustrated in FIG. 4B, the center of the coplanar line CPL and the vicinity thereof correspond to the maximum voltage point Em, and thus a position on a slightly inner side of the second end SP of the high-frequency transmission line 101 corresponds to an antinode in a voltage strength distribution. Precisely, the lowest frequency at which a standing wave develops is a little higher than the frequency expressed by equation (2).

Second Preferred Embodiment

Figure 6C:
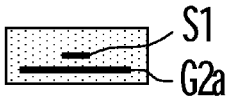
FIGS. 6A to 6G are cross-sectional views of individual portions of a high-frequency transmission line according to a second preferred embodiment of the present invention.
Figure 6E:
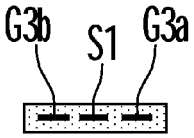
Figure 6G:
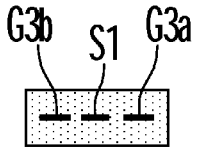
Figure 6A:
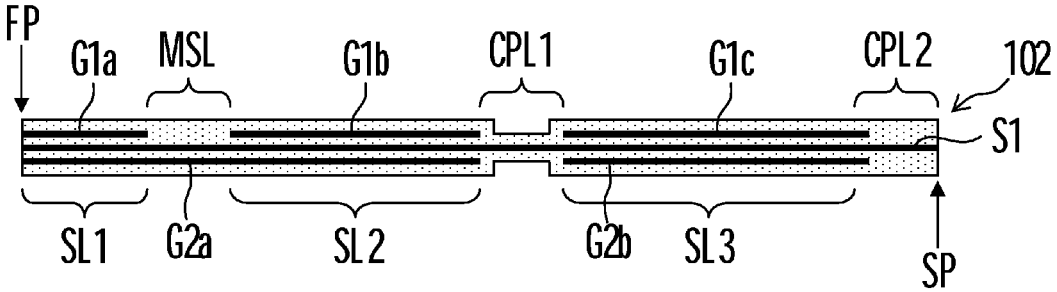
Figure 6B:
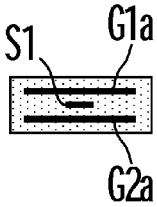
Figure 6D:
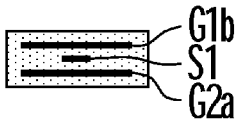
Figure 6F:
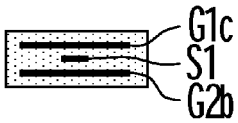
Figure 7:
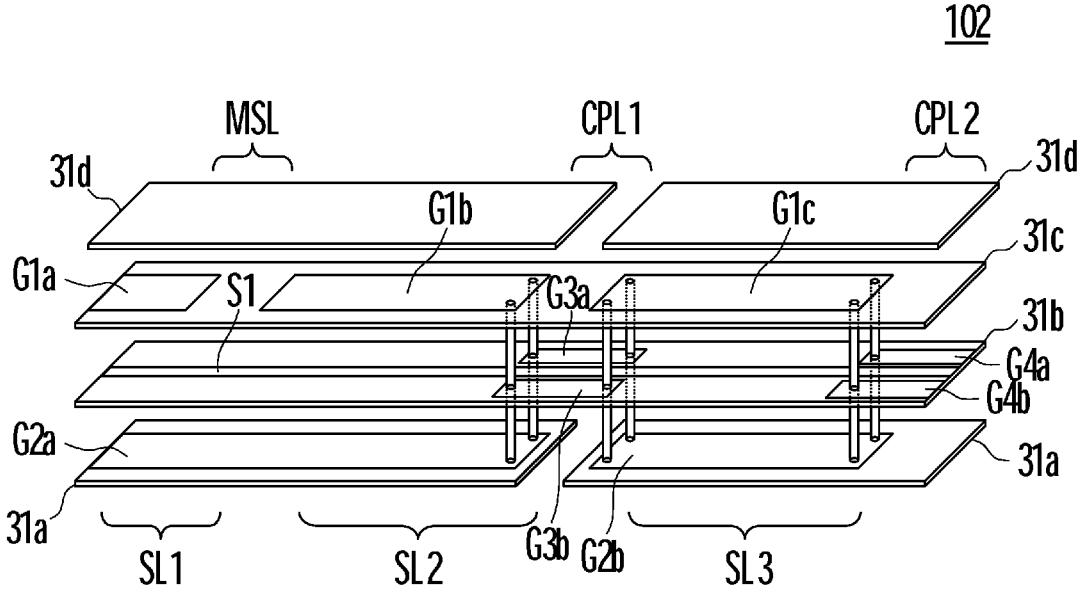
FIG. 7 is an exploded perspective view of the high-frequency transmission line according to the second preferred embodiment of the present invention.

FIGS. 6A to 6G are cross-sectional views of individual portions of a high-frequency transmission line 102 according to a second preferred embodiment of the present invention. FIG. 7 is an exploded perspective view of the high-frequency transmission line 102. FIG. 6A is a cross-sectional view in the longitudinal direction of the high-frequency transmission line 102. FIG. 6B is a cross-sectional view of the portion of a first strip line SL1 in FIG. 6A, FIG. 6C is a cross-sectional view of the portion of a microstrip line MSL in FIG. 6A, FIG. 6D is a cross-sectional view of the portion of a second strip line SL2 in FIG. 6A, FIG. 6E is a cross-sectional view of the portion of a first coplanar line CPL1 in FIG. 6A, FIG. 6F is a cross-sectional view of the portion of a third strip line SL3 in FIG. 6A, and FIG. 6G is a cross-sectional view of the portion of a second coplanar line CPL2 in FIG. 6A.

As illustrated in FIG. 6A, the high-frequency transmission line 102 includes the first strip line SL1, the microstrip line MSL, the second strip line SL2, the first coplanar line CPL1, the third strip line SL3, and the second coplanar line CPL2.

As illustrated in FIG. 7, the high-frequency transmission line 102 includes four dielectric substrates 31*a*, 31*b*, 31*c*, and 31*d*. Ground lines G2*a* and G2*b* are located on the upper surface of the substrate 31*a*. A signal line S1 and four ground lines G3*a*, G3*b*, G4*a*, and G4*b* are located on the upper surface of the substrate 31*b*. Three ground lines G1*a*, G1*b*, and G1*c* are located on the upper surface of the substrate 31*c*. The ground lines G1*b*, G3*a*, G3*b*, and G2*a* are connected by via conductors, as illustrated in FIG. 7. Also, the ground lines G1*c*, G3*a*, G3*b*, G4*a*, G4*b*, and G2*b* are connected by via conductors, as illustrated in FIG. 7.

The high-frequency transmission line 102 is a multilayer body including the substrates 31*a*, 31*b*, 31*c*, and 31*d* on which these various conductive lines are located. Note that the first coplanar line CPL1 is a multilayer body including the substrates 31*b* and 31*c*, and has a thickness smaller than that in the other line portion.

Figure 8A:
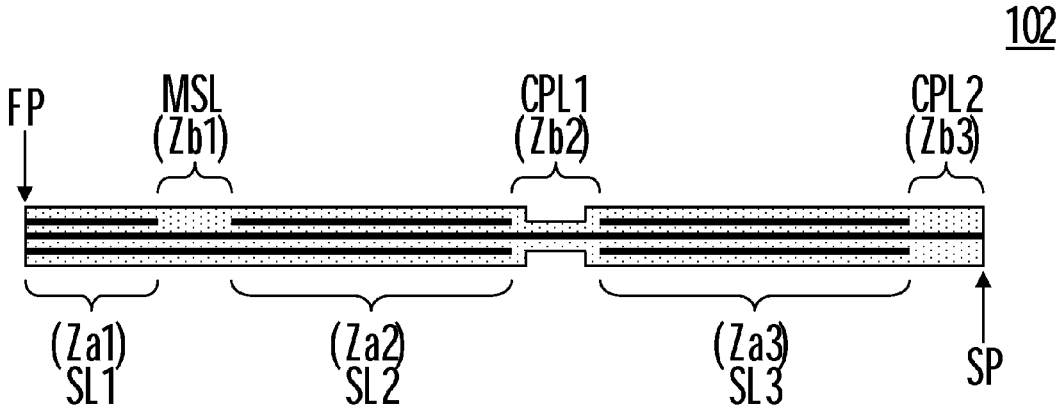
FIG. 8A is a diagram illustrating the characteristic impedances of individual portions of the high-frequency transmission line.
Figure 8B:
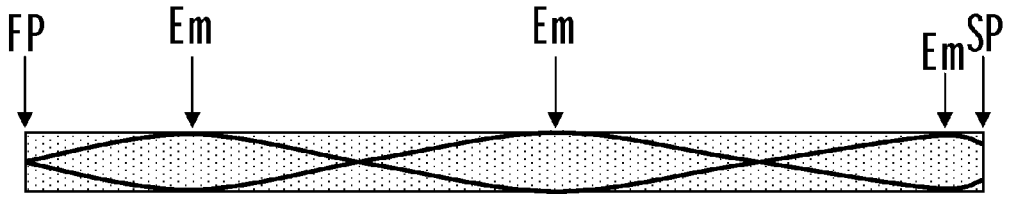
FIG. 8B is a diagram illustrating an example of a standing wave that develops in the high-frequency transmission line.

FIG. 8A is a diagram illustrating the characteristic impedances of individual portions of the high-frequency transmission line 102, and FIG. 8B is a diagram illustrating an example of a standing wave that develops in the high-frequency transmission line 102.

Each of the characteristic impedances Za1, Za2, and Za3 of the first, second, and third strip lines SL1, SL2, and SL3 preferably is about 50Ω, for example. The characteristic impedance Zb1 of the microstrip line MSL preferably is about 75Ω, for example. Each of the characteristic impedances Zb2 and Zb3 of the first and second coplanar lines CPL1 and CPL2 preferably is 200Ω, for example.

In a case where an antenna is connected to a first end FP of the high-frequency transmission line 102 and a connector is connected to a second end SP of the high-frequency transmission line 102, because the first end FP is a low-impedance end and the second end SP is a high-impedance end, resonance occurs at a frequency at which a standing wave develops in which the first end FP is a minimum voltage point (short-circuit end) and the second end SP is a maximum voltage point (open end). However, the characteristic impedance Zb1 of the microstrip line MSL is higher than the characteristic impedances Za1 and Za2 of the first and second strip lines SL1 and SL2 (Zb1>(Za1, Za2)), and thus a standing wave develops in which the position of the microstrip line MSL is a maximum voltage point (an antinode in a voltage strength distribution), as illustrated in FIG. 8B. Also, the characteristic impedances Zb2 and Zb3 of the first and second coplanar lines CPL1 and CPL2 are higher than the characteristic impedances Za2 and Za3 of the second and third strip lines SL2 and SL3 ((Zb2, Zb3)>(Za2, Za3)), and thus, at a certain frequency, a standing wave develops in which the positions of the first and second coplanar lines CPL1 and CPL2 are maximum voltage points (antinodes in a voltage strength distribution), as illustrated in FIG. 8B.

Therefore, a quarter-wavelength resonance mode illustrated in FIG. 1C, or a three-quarter-wavelength resonance mode illustrated in FIG. 4B does not occur. This is because, in these resonance modes, the voltage is not maximum at the portion of the microstrip line MSL and the portions of the first and second coplanar lines CPL1 and CPL2. In the second preferred embodiment, five-quarter-wavelength resonance in which the portion of the microstrip line MSL and the portions of the first and second coplanar lines CPL1 and CPL2 are maximum voltage points Em is a fundamental wave (lowest-order harmonic) mode. In other words, the first, second, and third strip lines SL1, SL2, and SL3, the microstrip line MSL, and the first and second coplanar lines CPL1 and CPL2 are disposed so that the positions of the maximum voltage points Em correspond to a transmission line of a high impedance and that a region separated therefrom corresponds to a transmission line of a low impedance in the state of five-quarter-wavelength resonance.

Figure 8C:
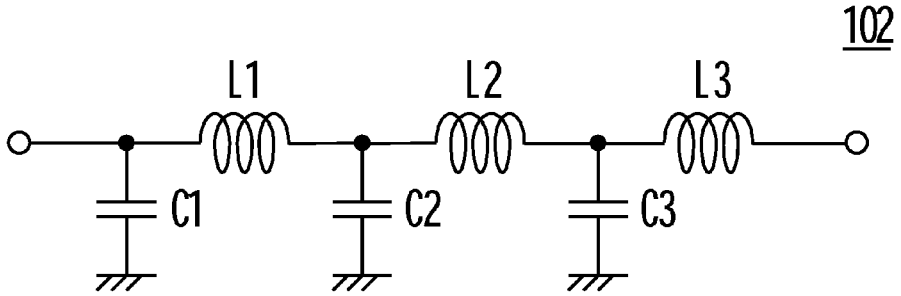
FIG. 8C is an equivalent circuit diagram in which the high-frequency transmission line is represented by a lumped-constant circuit.

FIG. 8C is an equivalent circuit diagram in which the high-frequency transmission line 102 is represented by a lumped-constant circuit. At the maximum voltage point Em and the vicinity thereof of the high-frequency transmission line 102, the density of electric field energy is high and the density of magnetic field energy is low. As the distance from the maximum voltage point Em increases, the density of electric field energy decreases and the density of magnetic field energy increases. Therefore, the portions where the density of electric field energy is high are represented by capacitors C1, C2, and C3, and the portions where the density of magnetic field energy is high are represented by inductors L1, L2, and L3.

According to the second preferred embodiment, one wavelength on the high-frequency transmission line 102 is represented by kg, and the line length is represented by Lg. In this case, a resonance frequency fo3 for five-quarter-wavelength resonance is expressed by the following equation (3).

$$fo3=5/(4Lg\sqrt{\in r})\times c(c\text{: velocity of light}) \quad (3)$$

In a case where Lg=9 cm and $\sqrt{\in r}=1$, five-quarter-wavelength resonance occurs at a high frequency of about 4.2 GHz. Thus, for example, a 2 GHz band is sufficiently higher than the cutoff frequency of the high-frequency transmission line 102, and a signal in a 2 GHz band can be transmitted with a low insertion loss.

Third Preferred Embodiment

Figure 9C:
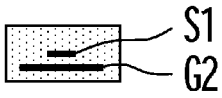
FIGS. 9A to 9D are cross-sectional views of individual portions of a high-frequency transmission line according to a third preferred embodiment of the present invention.
Figure 9A:
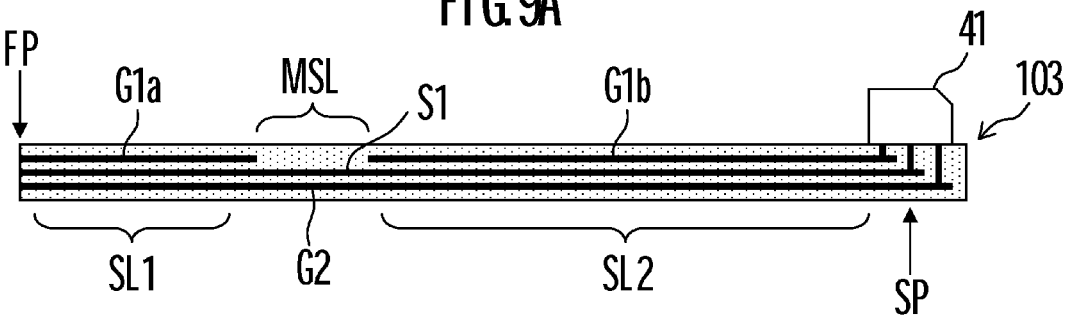
Figure 9B:
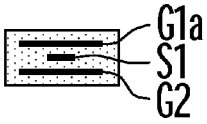
Figure 9D:
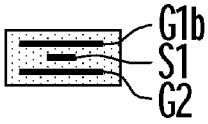
Figure 10:
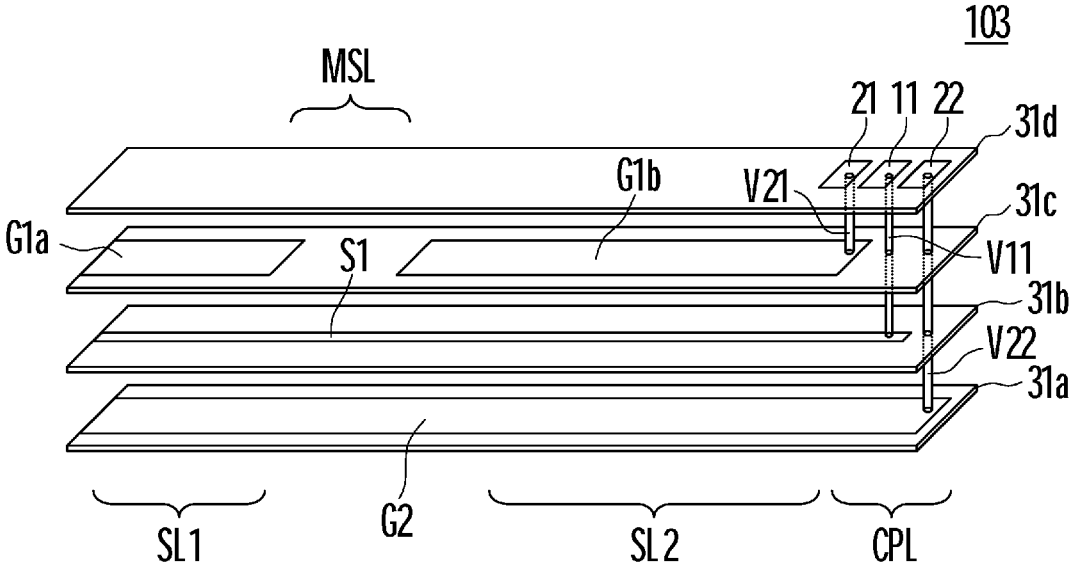
FIG. 10 is an exploded perspective view of the high-frequency transmission line according to the third preferred embodiment of the present invention.

FIGS. 9A to 9D are cross-sectional views of individual portions of a high-frequency transmission line 103 according to a third preferred embodiment of the present invention. FIG. 10 is an exploded perspective view of the high-frequency transmission line 103. FIG. 9A is a cross-sectional view in the longitudinal direction of the high-frequency transmission line 103. FIG. 9B is a cross-sectional view of the portion of a first strip line SL1 in FIG. 9A, FIG. 9C is a cross-sectional view of the portion of a microstrip line MSL in FIG. 9A, and FIG. 9D is a cross-sectional view of the portion of a second strip line SL2 in FIG. 9A.

As illustrated in FIG. 9A, the high-frequency transmission line 103 includes the first strip line SL1, the microstrip line MSL, the second strip line SL2, and a connector 41.

As illustrated in FIG. 10, the high-frequency transmission line 103 includes four dielectric substrates 31*a*, 31*b*, 31*c*, and 31*d*. A ground line G2 is located on the upper surface of the substrate 31*a*. A signal line S1 is located on the upper surface of the substrate 31*b*. Two ground lines G1*a* and G1*b* are located on the upper surface of the substrate 31*c*. A signal terminal 11 and ground terminals 21 and 22 are located on the upper surface of the substrate 31*d*. A via conductor V22 to connect the ground line G2 and the ground terminal 22 is located in the substrates 31*b* to 31*d*. A via conductor V11 to connect the signal line S1 and the signal terminal 11 is located in the substrates 31*c* and 31*d*. A via conductor V21 to connect the ground line G1*b* and the ground terminal 21 is located in the substrate 31*d*. The high-frequency transmission line 103 is a multilayer body including the substrates 31*a*, 31*b*, 31*c*, and 31*d* on which these various conductive lines are located.

In the third preferred embodiment, the via conductors V11, V21, and V22 define a coplanar line CPL that extends in the stacking direction (thickness direction) of the multilayer body. Also, the connector 41 is connected to the signal terminal 11 and the ground terminals 21 and 22.

Figure 11A:
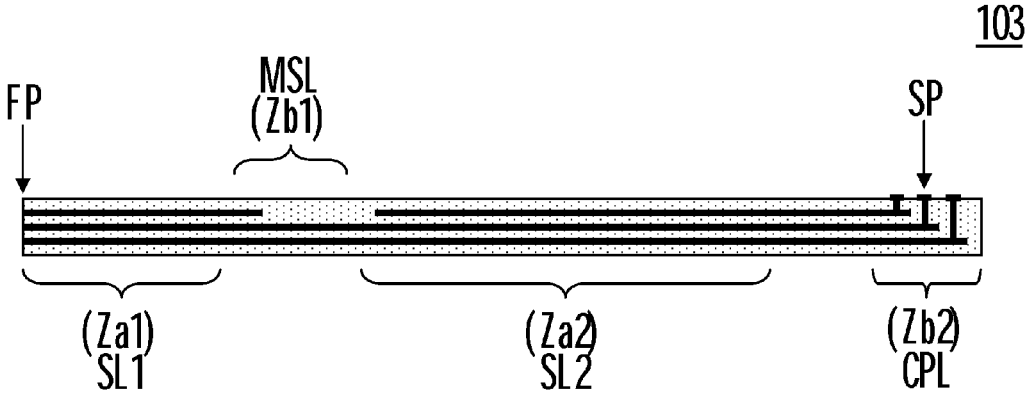
FIG. 11A is a diagram illustrating the characteristic impedances of individual portions of the high-frequency transmission line.
Figure 11B:
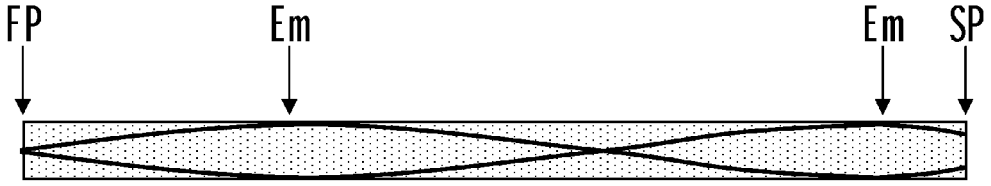
FIG. 11B is a diagram illustrating an example of a standing wave that develops in the high-frequency transmission line.

FIG. 11A is a diagram illustrating the characteristic impedances of individual portions of the high-frequency transmission line 103, and FIG. 11B is a diagram illustrating an example of a standing wave that develops in the high-frequency transmission line 103.

Each of the characteristic impedances Za1 and Za2 of the first and second strip lines SL1 and SL2 preferably is about 50Ω, for example. The characteristic impedance Zb1 of the microstrip line MSL preferably is about 75Ω, for example.

The characteristic impedance Zb2 of the coplanar line CPL preferably is about 200Ω, for example.

In a case where an antenna is connected to a first end FP of the high-frequency transmission line 103 and a connector is connected to a second end SP of the high-frequency transmission line 103, because the first end FP is a low-impedance end and the second end SP is a high-impedance end, resonance occurs at a frequency at which a standing wave develops in which the first end FP is a minimum voltage point (short-circuit end) and the second end SP is a maximum voltage point (open end). However, as in the first preferred embodiment, the characteristic impedance Zb1 of the microstrip line MSL is higher than the characteristic impedances Za1 and Za2 of the first and second strip lines SL1 and SL2 (Zb1>(Za1, Za2)), and thus a standing wave develops in which the position of the microstrip line MSL is a maximum voltage point (an antinode in a voltage strength distribution), as illustrated in FIG. 11B. Also, the characteristic impedance Zb2 of the coplanar line CPL is higher than the characteristic impedance Za2 of the second strip line SL2 (Zb2>Za2), and thus a standing wave develops in which the position of the coplanar line CPL is a maximum voltage point (antinode in a voltage strength distribution), as illustrated in FIG. 11B.

Therefore, as in the first preferred embodiment, a three-quarter-wavelength resonance is a fundamental wave (lowest-order harmonic) mode.

Figure 11C:
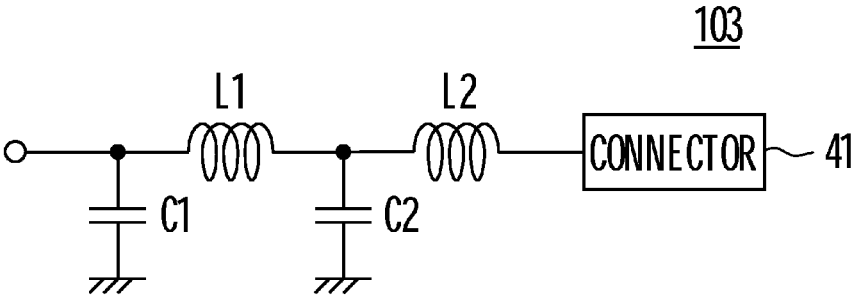
FIG. 11C is an equivalent circuit diagram in which the high-frequency transmission line is represented by a lumped-constant circuit.

FIG. 11C is an equivalent circuit diagram in which the high-frequency transmission line 103 is represented by a lumped-constant circuit. As in the first preferred embodiment, the portions where the density of electric field energy is high are represented by capacitors C1 and C2, and the portions where the density of magnetic field energy is high are represented by inductors L1 and L2.

Fourth Preferred Embodiment

Figure 12:
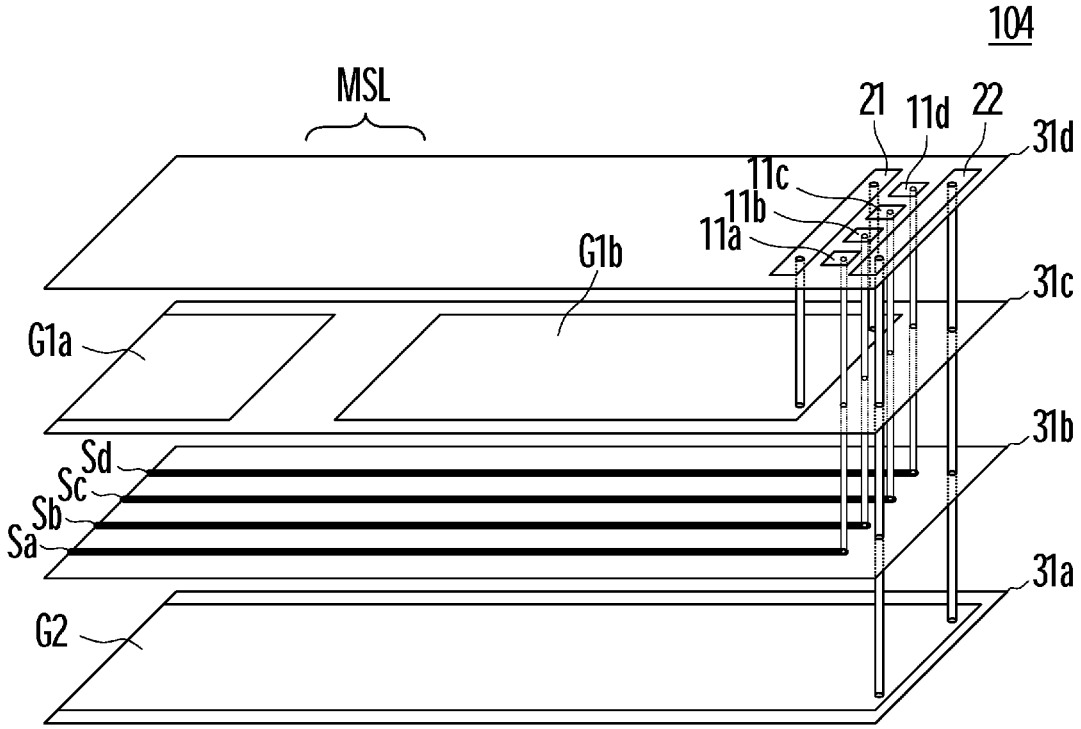
FIG. 12 is an exploded perspective view of a high-frequency transmission line according to a fourth preferred embodiment of the present invention.

FIG. 12 is an exploded perspective view of a high-frequency transmission line 104 according to a fourth preferred embodiment of the present invention. In the third preferred embodiment, the single signal line S1 is provided. In the fourth preferred embodiment, four signal lines Sa to Sd are provided. Specifically, a ground line G2 is located on a substrate 31*a*, four signal lines Sa to Sd are located on a substrate 31*b*, and ground lines G1*a* and G1*b* are located on a substrate 31*c*. Signal terminals 11*a* to 11*d* and ground terminals 21 and 22 are located on a substrate 31*d*. Via conductors to connect the ground line G2 and the ground terminal 22 are provided in the substrates 31*b* to 31*d*. Via conductors to respectively connect the signal lines Sa to Sd and the signal terminals 11*a* to 11*d* are located in the substrates 31*c* and 31*d*. Via conductors to connect the ground line G1*b* and the ground terminal 21 are located in the substrate 31*d*. The high-frequency transmission line 104 is a multilayer body including the substrates 31*a*, 31*b*, 31*c*, and 31*d* on which these various conductive lines are located.

Fifth Preferred Embodiment

Figure 13A:
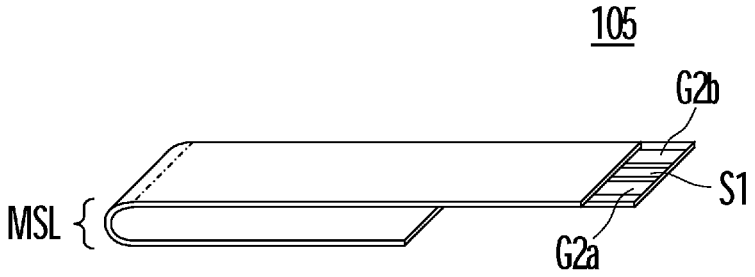
FIG. 13A is a perspective view of a high-frequency transmission line according to a fifth preferred embodiment of the present invention.
Figure 13B:
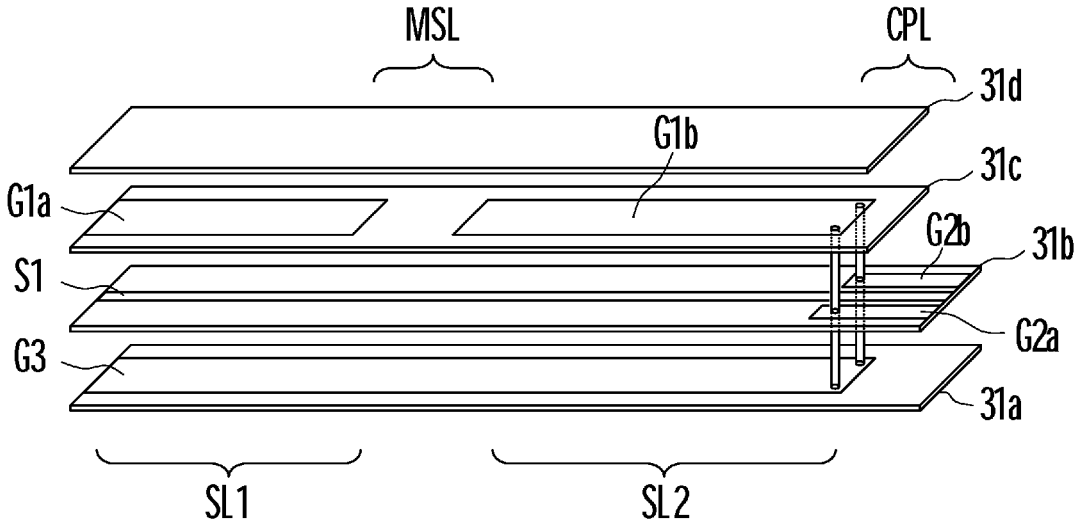
FIG. 13B is an exploded perspective view of the high-frequency transmission line.

FIG. 13A is a perspective view of a high-frequency transmission line 105 according to a fifth preferred embodiment of the present invention, and FIG. 13B is an exploded perspective view of the high-frequency transmission line 105. The configuration of the high-frequency transmission line 105 preferably is the same as that of the high-frequency transmission line 101 according to the first preferred embodiment. In particular, in the fifth preferred embodiment, an example of a high-frequency transmission line having a bent structure is described.

The portion of a microstrip line MSL of the high-frequency transmission line 105 includes, as conductive layers, a ground line G3 and a signal line S1, and is thus more flexible than the portions of first and second strip lines SL1 and SL2, and can be easily bent. The high-frequency transmission line 105 is bent at the portion of the microstrip line MSL illustrated in FIG. 13A and is integrated into an electronic apparatus.

Sixth Preferred Embodiment

Figure 14A:
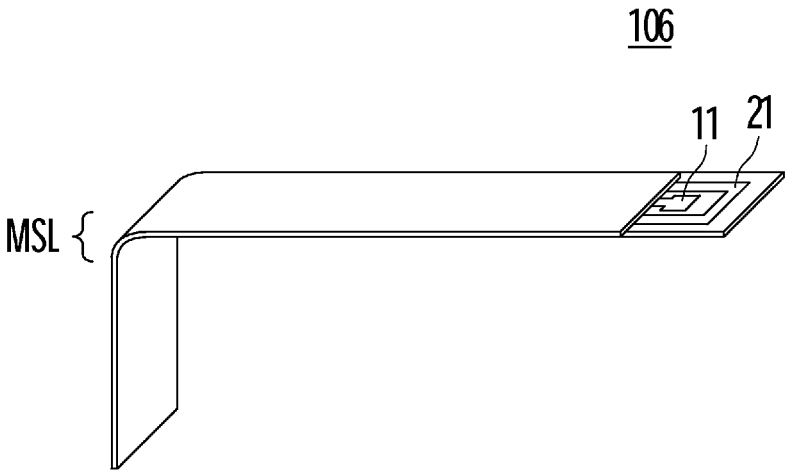
FIG. 14A is a perspective view of a high-frequency transmission line according to a sixth preferred embodiment of the present invention.
Figure 14B:
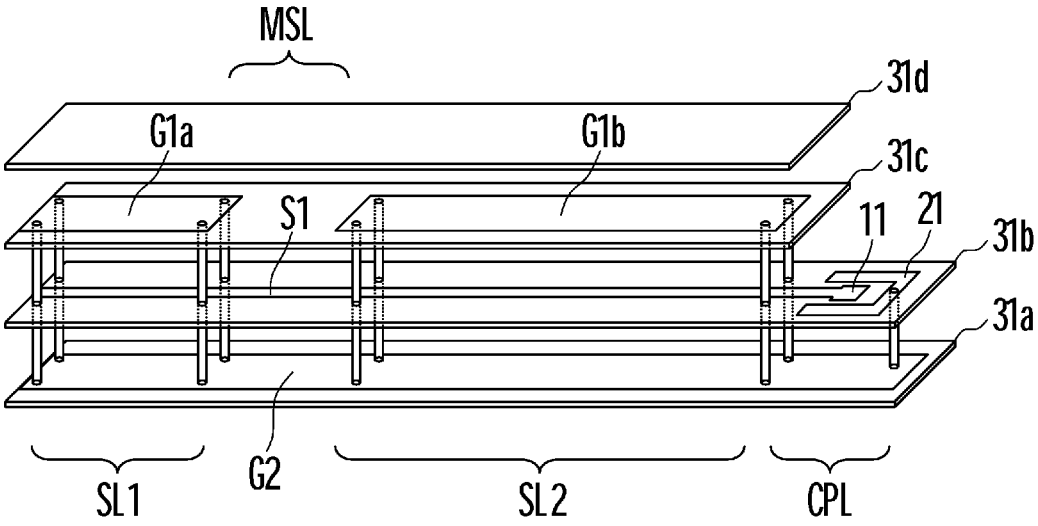
FIG. 14B is an exploded perspective view of the high-frequency transmission line.

FIG. 14A is a perspective view of a high-frequency transmission line 106 according to a sixth preferred embodiment, and FIG. 14B is an exploded perspective view of the high-frequency transmission line 106.

As illustrated in FIG. 14B, the high-frequency transmission line 106 includes four dielectric substrates 31*a*, 31*b*, 31*c*, and 31*d*. A ground line G2 is located on the upper surface of the substrate 31*a*. A signal line S1, a signal terminal 11, and a ground terminal 21 are located on the upper surface of the substrate 31*b*. Two ground lines G1*a* and G1*b* are located on the upper surface of the substrate 31*c*. The high-frequency transmission line 106 is a multilayer body including the substrates 31*a*, 31*b*, 31*c*, and 31*d* on which these various conductive lines are located. As illustrated in FIG. 14B, the ground lines G1*a*, G1*b*, and G2 are connected by via conductors. The ground terminal 21 is connected to the ground line G2 by a via conductor.

The signal terminal 11 and the ground terminal 21 define a coplanar line CPL, and a connector is connected to this portion. The portion of a microstrip line MSL of the high-frequency transmission line 106 includes, as conductive layers, the ground line G2 and the signal line S1, and is thus more flexible than the portions of first and second strip lines SL1 and SL2, and can be easily bent. The high-frequency transmission line 106 is bent at the portion of the microstrip line MSL illustrated in FIG. 14A and is integrated into an electronic apparatus.

Seventh Preferred Embodiment

Figure 15:
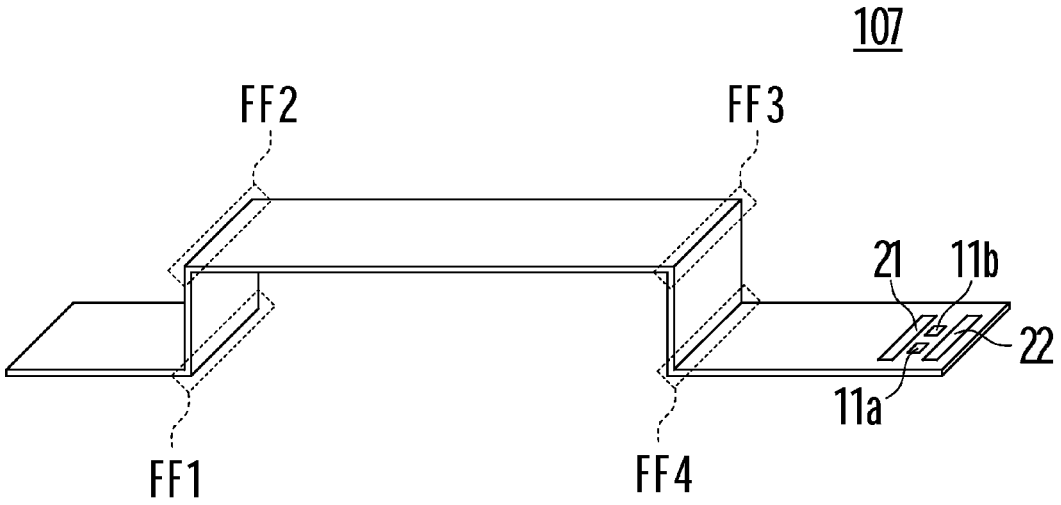
FIG. 15 is a perspective view of a high-frequency transmission line according to a seventh preferred embodiment of the present invention.

FIG. 15 is a perspective view of a high-frequency transmission line 107 according to a seventh preferred embodiment of the present invention. In this example, the high-frequency transmission line 107 is preferably bent at four bent portions FF1 to FF4. The bent portions FF1 to FF4 of the high-frequency transmission line 107 correspond to a microstrip line or a coplanar line, and the other portions correspond to strip lines. The high-frequency transmission line 107 includes two signal lines. Two signal terminals 11*a* and 11*b* and two ground terminals 21 and 22 are disposed at one end of the high-frequency transmission line 107.

Basically, the microstrip line preferably includes two conductive layers, and the coplanar line preferably includes one conductive layer. Thus, the microstrip line and coplanar line are more flexible than a strip line, and can be easily bent.

Figure 16:
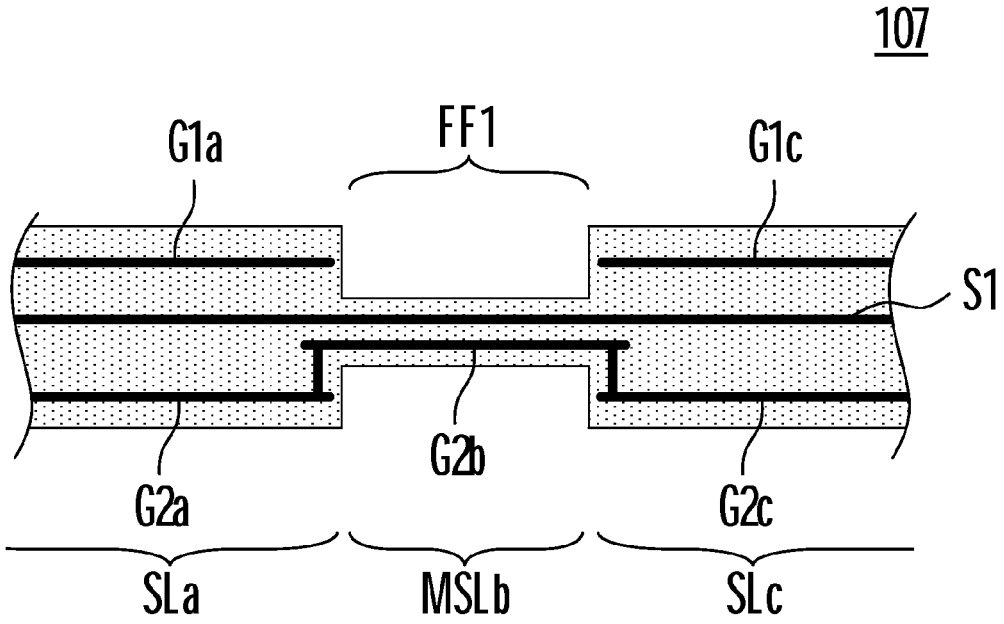
FIG. 16 is a cross-sectional view of a bent portion and the vicinity thereof among four bent portions.

FIG. 16 is a cross-sectional view of the bent portion FF1 and the vicinity thereof among the bent portions FF1 to FF4. The configuration of the bent portions FF2 to FF4 and the vicinities thereof is the same. In this example, the portion of a strip line SLa includes ground lines G1*a* and G2*a* and a signal line S1. The portion of a strip line SLc includes ground lines G1*c* and G2*c* and the signal line S1. The portion of a microstrip line MSLb includes a ground line G2*b* and the signal line S1. The portion of the microstrip line MSLb has a smaller thickness than the portions of the strip lines SLa and SLc. The distance between the signal line S1 and the ground line G2*b* is determined so that the characteristic impedance of the portion of the microstrip line MSLb is higher than the characteristic impedances of the portions of the strip lines SLa and SLc.

Alternatively, the portion between the bent portions FF1 and FF2, and the portion between the bent portions FF3 and FF4 may be defined by a microstrip line or a coplanar line, for example.

Eighth Preferred Embodiment

Figure 17:
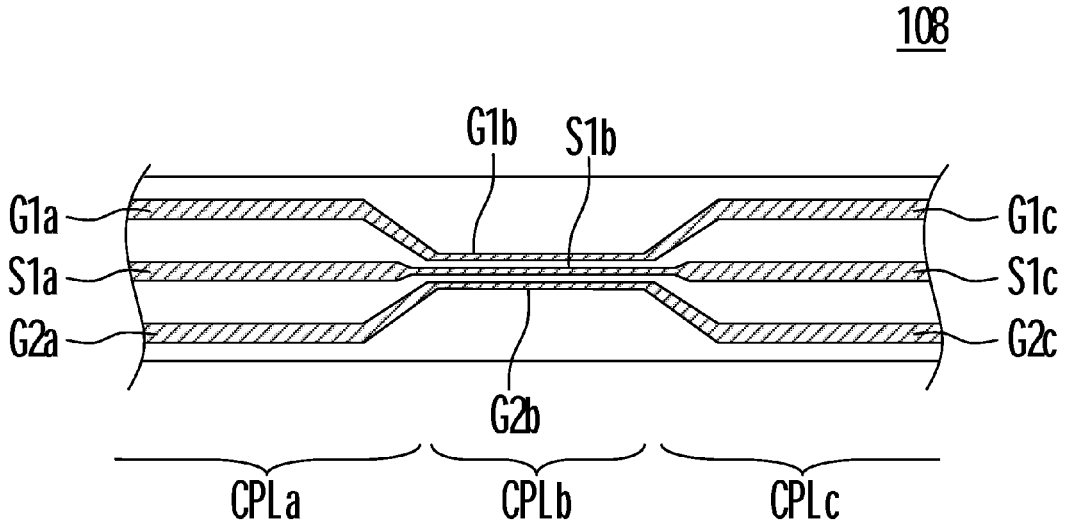
FIG. 17 is a partial plan view of a high-frequency transmission line according to an eighth preferred embodiment of the present invention.

FIG. 17 is a partial plan view of a high-frequency transmission line 108 according to an eighth preferred embodiment of the present invention.

In the above-described preferred embodiments, different types of transmission lines having different characteristic impedances are connected and thus a transmission mode is changed. Alternatively, the same type of transmission lines may be used and the characteristic impedance of a certain portion may be changed. In the example illustrated in FIG. 17, coplanar lines CPLa and CPLc having a high impedance and a coplanar line CPLb having a low impedance preferably are connected in order. Specifically, the coplanar line CPLa including a signal line Sia and ground lines G1*a* and G2*a*, the coplanar line CPLb including a signal line S1*b* and ground lines G1*b* and G2*b*, and the coplanar line CPLc including a signal line S1*c* and ground lines G1*c* and G2*c* are connected in order.

Certain characteristic impedances may be obtained by setting the widths of signal lines and a distance between a signal line and a ground line in this manner.

Ninth Preferred Embodiment

Figure 18A:
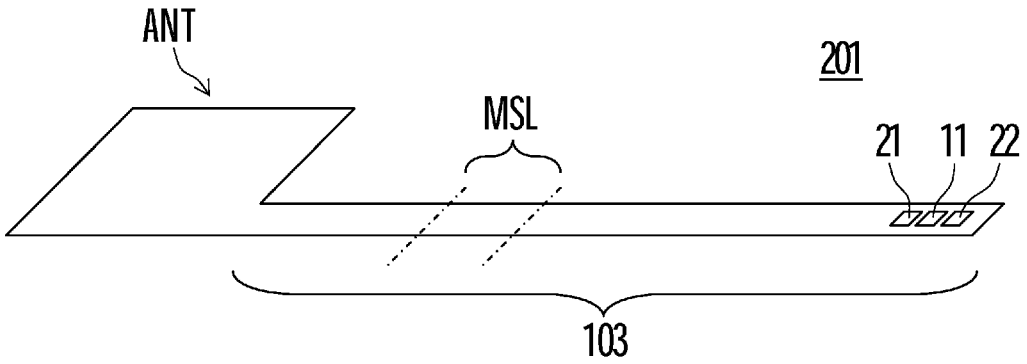
FIG. 18A is a perspective view of an antenna device according to a ninth preferred embodiment of the present invention.
Figure 18B:
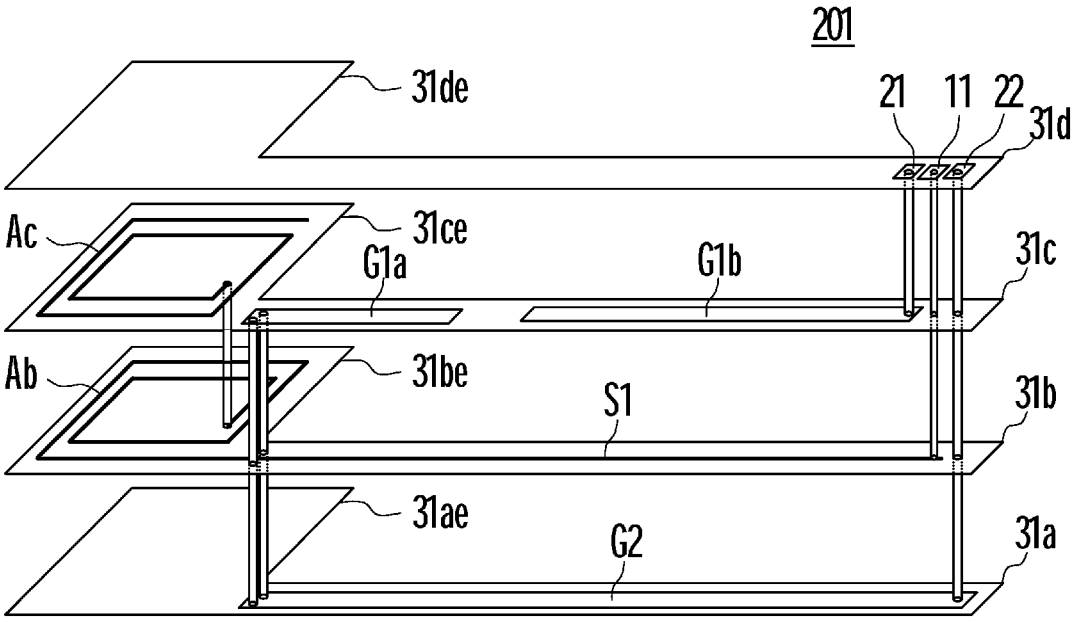
FIG. 18B is an exploded perspective view of the antenna device.

FIG. 18A is a perspective view of an antenna device 201 according to a ninth preferred embodiment of the present invention, and FIG. 18B is an exploded perspective view of the antenna device 201. The antenna device 201 is a device including the high-frequency transmission line 103 according to the third preferred embodiment illustrated in FIG. 9 and an antenna element ANT, that is, an antenna device including a high-frequency transmission line and a connector.

Substrates 31*a* to 31*d* respectively include rectangular or substantially rectangular extended portions 31*ae* to 31*de*. Spiral coil antennas Ab and Ac serving as antenna elements are respectively provided in the extended portions 31*be* and 31*ce*. An outer end of the coil antenna Ab is connected to a signal line S1, and an inner end thereof is connected to an outer end of the coil antenna Ac. The portions where the coil antennas Ab and Ac are located are sandwiched between the extended portions 31*ae* and 31*de*.

Figure 19:
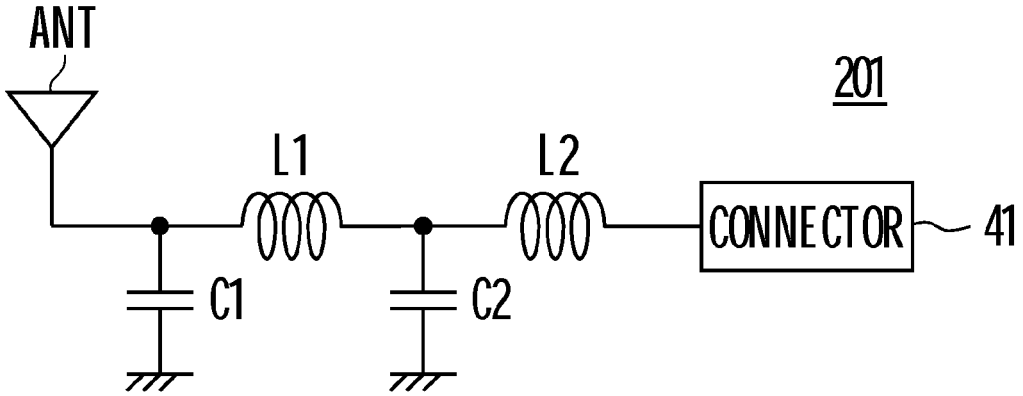
FIG. 19 is an equivalent circuit diagram of the antenna device.

FIG. 19 is an equivalent circuit diagram of the antenna device 201. The characteristic impedance of the antenna element ANT preferably is about 1Ω to about 25Ω, for example, and the characteristic impedance of a connector 41 preferably is about 200Ω, for example. As described above in the third preferred embodiment, the fundamental wave mode (lowest-order harmonic mode) of the high-frequency transmission line 103 is a three-quarter-wavelength resonance mode. Thus, the lowest-order cutoff frequency is three times the frequency of a high-frequency transmission line having a structure according to the related art, and accordingly a low insertion loss characteristic is obtained over a wide band.

Other Preferred Embodiments

In the above-described preferred embodiments, a strip line, a microstrip line, and a coplanar line are used as examples of transmission lines having different characteristic impedances. Alternatively, various preferred embodiments of the present invention are applicable to a transmission line including a coplanar waveguide with a ground, coplanar strips, and a slot line.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency transmission line comprising:

a first end that is a low-impedance end;

a second end that is a high-impedance end;

a first portion including:

a low-impedance portion with a low characteristic impedance; and a high-impedance portion with a characteristic impedance higher than the low-impedance portion; and a second portion in which a characteristic impedance changes from a relatively high value to a relatively low value in a path extending from the first end toward the second end along the high-frequency transmission line; wherein the low-impedance portion and the high-impedance portion are arranged so that resonance of a quarter wavelength multiplied by an odd number that is three or higher occurs; and the second end is at a position other than an antinode in a voltage strength distribution.

2. The high-frequency transmission line according to claim 1, further comprising a multilayer body including a plurality of dielectric layers and line conductors, and is bent at the high-impedance portion.

3. The high-frequency transmission line according to claim 2, wherein the high-impedance portion has a smaller number of dielectric layers than the low-impedance portion.

4. The high-frequency transmission line according to claim 1, wherein the low-impedance portion includes a strip line, and the high-impedance portion includes a microstrip line or a coplanar line.

5. The high-frequency transmission line according to claim 1, wherein the low-impedance end is an antenna connection end, and the high-impedance end is a connector connection end.

6. The high-frequency transmission line according to claim 1, further comprising:

a plurality of dielectric substrates;

ground lines and signal lines on respective ones of the plurality of dielectric substrates; and via conductors connecting respective ones of the ground lines and signal lines.

7. The high-frequency transmission line according to claim 1, further comprising at least two strip lines, a microstrip line and a coplanar line, wherein characteristic impedances of the at least two strip lines is about 50106 , characteristic impedance of the microstrip line is about 75Ω, and characteristic impedance of the coplanar line is about 200106 .

8. The high-frequency transmission line according to claim 1, wherein the antinode in the voltage strength distribution includes a number of antinodes in the voltage strength distribution; and the low-impedance portion and the high-impedance portion are arranged so that resonance occurs in which the number of antinodes in the voltage strength distribution is two or more.

9. The high-frequency transmission line according to claim 1, wherein the low-impedance portion and the high-impedance portion include at least one of a coplanar waveguide with a ground, a coplanar strip and a slot line.

10. An antenna device comprising:

the high-frequency transmission line according to claim 1; and an antenna element connected to the low-impedance end; wherein the high-frequency transmission line includes a multilayer body including a plurality of dielectric layers and line conductors, and the antenna element is provided in the multilayer body integrally with the high-frequency transmission line.

11. A high-frequency transmission line comprising:

a first end that is a low-impedance end;

a second end that is a high-impedance end;

a first portion including:

a low-impedance portion with a low characteristic impedance; and a high-impedance portion with a characteristic impedance higher than the low-impedance portion; and a second portion in which a characteristic impedance changes from a relatively high value to a relatively low value in a path extending from the first end toward the second end along the high-frequency transmission line; wherein the low-impedance portion and the high-impedance portion are arranged so that resonance occurs in which a number of antinodes in a voltage strength distribution is two or more; and the second end is at a position other than the antinodes in the voltage strength distributions.

12. The high-frequency transmission line according to claim 11, further comprising a multilayer body including a plurality of dielectric layers and line conductors, and is bent at the high-impedance portion.

13. The high-frequency transmission line according to claim 12, wherein the high-impedance portion has a smaller number of dielectric layers than the low-impedance portion.

14. The high-frequency transmission line according to claim 11, wherein the low-impedance portion includes a strip line, and the high-impedance portion includes a microstrip line or a coplanar line.

15. The high-frequency transmission line according to claim 11, wherein the low-impedance end is an antenna connection end, and the high-impedance end is a connector connection end.

16. The high-frequency transmission line according to claim 11, further comprising:

a plurality of dielectric substrates;

ground lines and signal lines on respective ones of the plurality of dielectric substrates; and via conductors connecting respective ones of the ground lines and signal lines.

17. The high-frequency transmission line according to claim 11, further comprising at least two strip lines, a microstrip line and a coplanar line, wherein characteristic impedances of the at least two strip lines is about 50106 , characteristic impedance of the microstrip line is about 75106 , and characteristic impedance of the coplanar line is about 200106 .

18. The high-frequency transmission line according to claim 11, the low-impedance portion and the high-impedance portion are arranged so that three-quarter-wavelength resonance or five-quarter-wavelength resonance occurs.

19. The high-frequency transmission line according to claim 11, wherein the low-impedance portion and the high-impedance portion include at least one of a coplanar waveguide with a ground, a coplanar strip and a slot line.

20. An antenna device comprising:

the high-frequency transmission line according to claim 11; and an antenna element connected to the low-impedance end; wherein the high-frequency transmission line includes a multilayer body including a plurality of dielectric layers and line conductors, and the antenna element is provided in the multilayer body integrally with the high-frequency transmission line.

* * * * *